United States Patent [19]

Skopek

[11] Patent Number: 5,058,501

[45] Date of Patent: Oct. 22, 1991

[54] SELF-INKING TUMBLE TYPE HAND STAMP

[76] Inventor: Karl Skopek, Dr. Franz Arming Str. 5, A-4600 Wels, Austria

[21] Appl. No.: 474,789

[22] PCT Filed: Sep. 14, 1989

[86] PCT No.: PCT/AT89/00085

§ 371 Date: May 10, 1990

§ 102(e) Date: May 10, 1990

[87] PCT Pub. No.: WO90/02657

PCT Pub. Date: Mar. 22, 1990

[30] Foreign Application Priority Data

Sep. 14, 1988 [AT] Austria ..... 2259/89

[51] Int. Cl.[5] ..... B41K 1/42

[52] U.S. Cl. ..... 101/334; 101/104

[58] Field of Search ..... 101/334, 104, 105, 103, 101/333

[56] References Cited

U.S. PATENT DOCUMENTS

| | | | |
|---|---|---|---|
| 104,967 | 7/1870 | Lehman | 101/104 |
| 232,349 | 9/1880 | Hill | 101/334 |
| 233,285 | 10/1880 | Scotford | 101/334 |
| 280,652 | 7/1883 | Moise | 101/334 |
| 527,208 | 10/1894 | Leavenworth | 101/334 |
| 655,379 | 8/1900 | Scotford | 101/334 |
| 973,556 | 10/1910 | Peterson | 101/334 |
| 1,042,766 | 10/1912 | Carleton | 101/334 |
| 1,085,489 | 1/1914 | Rushworth | 101/334 |
| 1,710,633 | 4/1929 | Marks | 101/105 |
| 1,730,365 | 10/1929 | Grabler | 101/105 |
| 2,079,080 | 5/1937 | Melino | 101/334 |
| 2,314,828 | 4/1943 | Humphries | 101/334 |
| 2,829,594 | 4/1958 | Goc | 101/334 |
| 3,466,690 | 8/1886 | Scotford | 101/334 |
| 3,779,164 | 12/1973 | Study | 101/334 |
| 4,823,691 | 4/1989 | Müller | 101/104 |
| 4,823,696 | 4/1989 | Skopek | 101/334 |

FOREIGN PATENT DOCUMENTS

| | | | |
|---|---|---|---|
| 8704980 | 8/1887 | Austria | 101/334 |
| 232014 | 2/1964 | Austria | 101/334 |
| 1037313 | 2/1975 | Canada | 101/104 |
| 634393 | 8/1936 | Fed. Rep. of Germany | 101/104 |

*Primary Examiner*—Edgar S. Burr
*Assistant Examiner*—E. P. Raciti
*Attorney, Agent, or Firm*—Collard, Roe & Galgano

[57] ABSTRACT

A self-inking pad has a reversible mechanism (3) for the print characters (4) arranged in a housing (2) and a metallic actuator yoke (7) slidably mounted on the housing (2), overlapping the same. The actuator yoke can be pressed down against the force of a return spring (9) in order to effect printing of the print characters, a handle (10) being arranged on the actuator yoke for that purpose. The handle is hollow, receives and supports an end (9*a*) of the return spring (9), whereas the other end (9*b*) of the return spring (9) is supported by a crosspiece (11) of the housing (2) and is surrounded by a sleeve (12) arranged on said crosspiece. When the actuator yoke is pressed down, the sleeve is pushed into the cavity of the handle (10). The sleeve is provided with at least one recess into which a sliding catch (17) arranged in a guide and linked to the actuator yoke (7) can be pushed in order to lock the actuator yoke in a determined position of its path of travel. The handle (19) is made of rigid plastics and is secured to the actuator yoke (7) by screws or pegs (20, 21) that extend through recesses (23) in the actuator yoke (7). When the handle is secured by means of pegs, the pegs (20, 21) are integrally moulded with the handle (10). The guide for the sliding catch (17) is located in the handle (10).

7 Claims, 3 Drawing Sheets

SELF-INKING TUMBLE TYPE HAND STAMP

BACKGROUND OF THE INVENTION

1. Field of the Invention

The invention relates to a self-inking tumble type hand stamp with a reversing mechanism for the print characters arranged in a housing, and with a metallic actuator for the reversing mechanism. The actuator yoke is slidably mounted on the housing, overlapping the latter, and is depressible against the force of a return spring in order to effect printing of the print characters, for which purpose the actuator yoke is provided with a hollow handle receiving and supporting one end of the return spring, whereas the other end of the pull-back spring is supported by a crosspiece of the housing and is surrounded by a sleeve arranged on said crosspiece. The sleeve is pushed into the cavity of the handle when the actuator yoke is depressed and has at least one recess into which a sliding catch arranged in a guide and linked to the actuator yoke can be pushed in order to lock the actuator yoke in a defined position of its path of travel.

2. Description of the Prior Art

In known self-inking hand stamps of the above type, the handle is fastened on the actuator yoke by means of a metal sleeve, which in turn is riveted into the opening on the actuator yoke for the passage of the return spring. The handle is then pushed over said sleeve, whereby the latter is inserted in the cavity of the handle, and the handle is fixed on said sleeve in a suitable way, for example by fit, glueing or the like. In said known self-inking hand stamps, the sliding catch is supported in a guide, for which provision is made in the actuator yoke at the point of passage of the return spring, or in the sleeve surrounding the latter. Such known self-inking hand stamps involve a relatively high manufacturing expenditure due to the aforementioned way in which the handle is mounted on the bow-shaped actuator and the way in which the guide for the sliding catch is provided on the metal-made actuator yoke. A further drawback is that processing operations involving close tolerances have to be carried out in relatively unfavorable locations, i.e., within the proximity of material bends.

SUMMARY OF THE INVENTION

It is an object of the present invention to create a self-inking hand stamp of the type specified above for which the expenditure required for manufacturing the handle and its mounting on the actuator yoke, and the expenditure needed for making the sliding catch and the guide for the latter are distinctly less than heretofore, without curtailing the usefulness of the hand stamp.

The self-inking hand stamp according to the invention has a handle which is made of rigid plastic material and fixed on the actuator yoke by means of a plurality of screws or pegs leading through holes in the actuator within the proximity of the outer edge of the handle disposed on the actuator yoke. In the case where pegs are used, the latter are shaped by integral molding on the side of the handle facing the actuator yoke. The guide for the sliding catch is arranged in the handle. Such a hand stamp appropriately meets the aforementioned object. The handle, which can be manufactured in a relatively simple way by pressing or injection molding from rigid plastics, can be fixed on the actuator in a simple and labor-saving way by means of the screws or pegs integrally molded with the handle. Furthermore, a guide for the sliding catch can be formed in the handle in the course of manufacture of the latter without excessively increasing the manufacturing expenditure for making said handle.

A very simple embodiment in terms of construction is obtained if provision is made for fixing the handle on the actuator yoke with self-tapping screws.

A very simple embodiment in terms of construction is obtained if provision is made for fixing the handle on the actuator yoke with self-tapping screws.

A particularly simple assembly of the handle on the actuator yoke is achievable if pegs are integrally molded with the actuator yoke and provided with hook-like attachments or undercuts for keeping the pegs locked in the actuator yoke. In another advantageous embodiment requiring relatively little labor for fixing the pegs in the actuator yoke and thus fastening the handle, the pegs are integrally molded with the bow-shaped actuator and locked in the recesses of the latter by plastic deformation. Such plastic deformation of the pegs on the handle can be accomplished, for example, by pressing the ends of the pegs flat, or by widening the diameter of the pegs. Such deformation can be produced, for example with a heated tool, or with a tool generating ultrasound vibration.

Furthermore, for mounting the handle on the actuator yoke, as well as for appropriately guiding the pull-back spring or the sleeve surrounding the latter within the actuator yoke and handle, it is advantageous if the handle, on its side facing the actuator yoke, has a guide attachment surrounding the return spring or the sleeve arranged around the latter, said attachment projecting into the actuator yoke. In addition, it is beneficial to the manufacture and for the guidance of the return spring and sleeve surrounding the latter if said guide attachment is part of a guide sleeve that is arranged in the handle with a spacing from the outer wall of the handle and is made of one piece with such handle, with the return spring being supported in said guide sleeve.

BRIEF DESCRIPTION OF THE DRAWINGS

The invention will be explained in greater detail in the following by reference to the embodiments schematically shown in the drawing. In the drawing.

DESCRIPTION OF THE PREFERRED EMBODIMENTS

Figure 2:
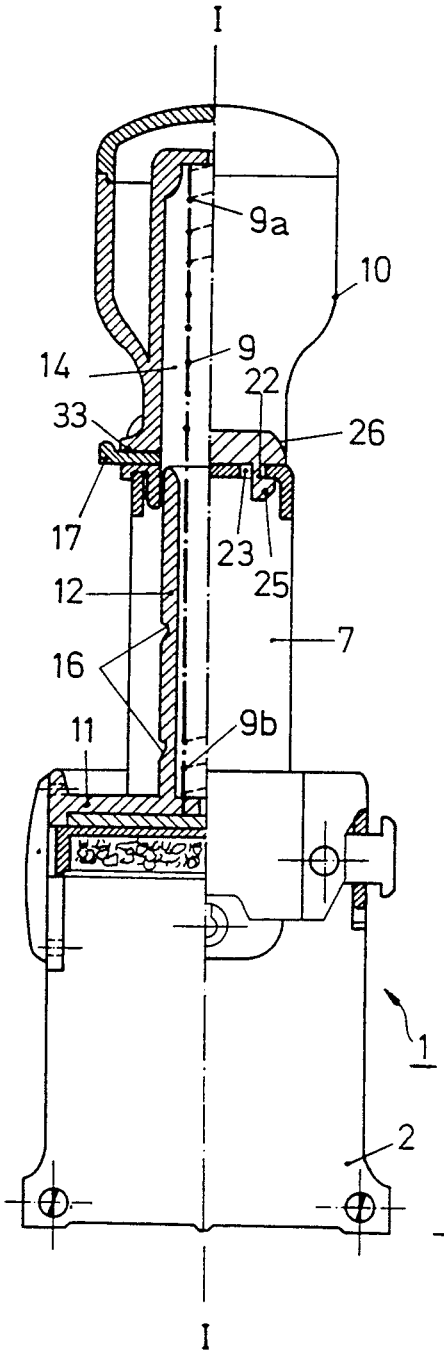
FIG. 2 shows a side view of the hand stamp partly, in a sectional view taken along line II—II in FIG. 1.
Figure 1:
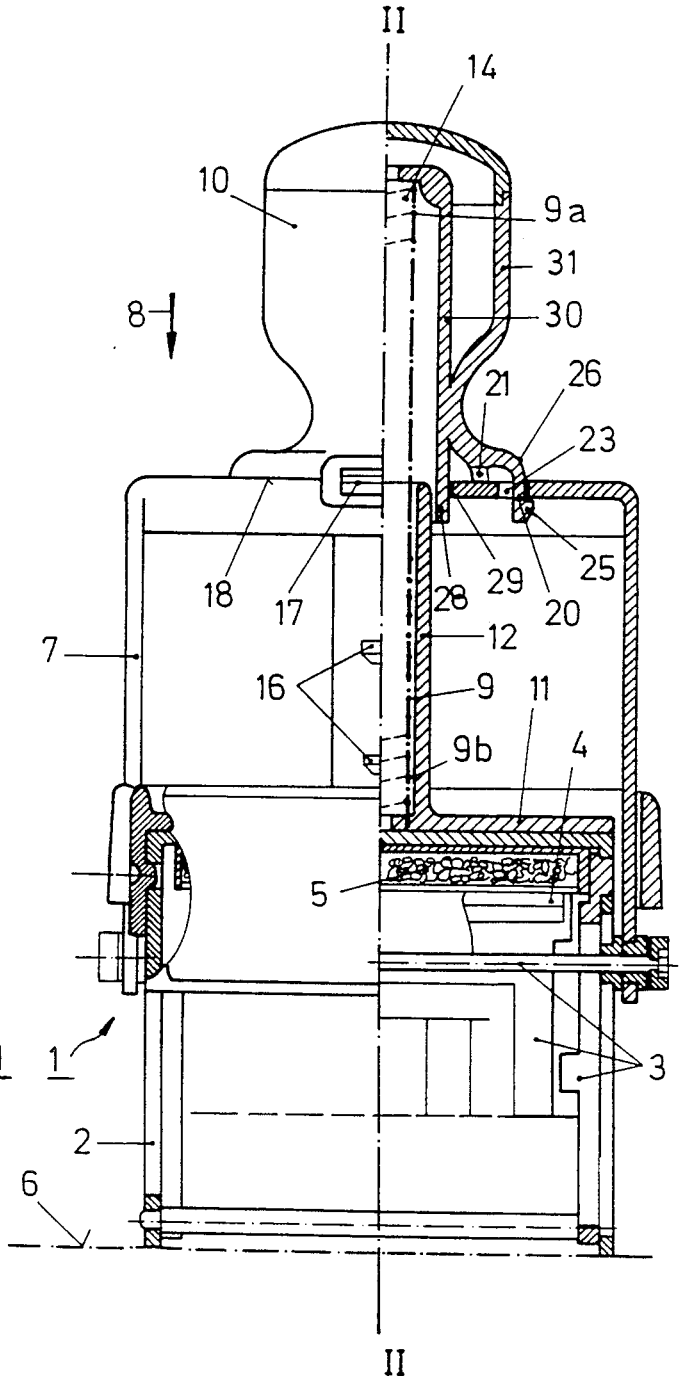
FIG. 1 shows an embodiment of a self-inking hand stamp, partly in a front view and partly in a sectional view taken along line I—I in FIG. 2.

The self-inking hand stamp shown in FIGS. 1 and 2 has a housing 2, in which a reversing mechanism 3 for the print characters 4 of the tumble type hand stamp is arranged. The print characters 4 abut an ink pad 5 when the self-inking hand stamp 1 is in its rest position, and, with the reversing mechanism 3, can be moved into the printing position by a swinging reversing motion causing the print characters to face a surface 6 and produce a print on said surface. The reversing mechanism 3 is actuated by a metallic actuator yoke 7, which is slidably supported on the housing 2 for upward and downward displacement. For producing a print, said actuator yoke can be pressed down from the rest position shown in FIGS. 1 and 2 in the direction of arrow 8 against the force of a return spring 9 arranged in the stamp. For depressing the actuator yoke 7, it is provided with a handle 10, which is hollow and receives and supports within its interior cavity 14 one end 9*a* of the return spring 9; the other end 9*b* of said pull-back spring is supported on a crosspiece 11 of the housing 2 of the stamp and is surrounded by a sleeve 12 arranged on said crosspiece 11. When the actuator yoke 7 is depressed, the sleeve 12 is pushed into the cavity 14 of the handle 10. The sleeve 12 defines recesses 16 into which a sliding catch 17 connected to the actuator 7 can be pushed in order to lock the actuator 7 in a defined position of the path of travel of the actuator yoke 7. In this way, the reversible mechanism 3 can be locked in positions permitting a trouble-free exchange of the ink pad 5 or adjustment of adjustable print characters.

For mounting the handle 10 on the actuator yoke 7, said handle has a plurality of pegs 20, 21, 22 integrally molded on its side 18 facing the actuator yoke 7, said pegs engaging the holes 23 the actuator yoke 7, and fixing the handle 10 on the actuator yoke 7. In the embodiment shown in FIGS. 1 and 2, the pegs 20 are provided with the hook attachments 25, which keep the pegs snap-locked in the actuator yoke 7. Similarly shaped undercuts may be used instead of such hook attachments 25. The pegs 20 are disposed along the outer edge 26 of the side 18 of the handle 10 facing the actuator yoke 7. Correspondingly, holes 23 are disposed within the proximity of the outer edge 26 of the handle 10. This results in a very stable fit and prevents reactions upon the center range where the return spring 19 is guided.

On its side 18 facing the actuator yoke 7, the handle 10 has a guide attachment 28 surrounding the return spring 9 and the sleeve 12 arranged around said return spring 9, said attachment projecting into the actuator yoke 7, for which purpose an opening 29 is provided in the actuator yoke 7. Said guide attachment 28 contributes to the lateral positioning and fixing of the handle 10 relative to the actuator yoke 7. Said guide attachment 28, furthermore, is part of a guide sleeve 30, which is arranged in the handle 10 with a spacing from the outer wall 31 of the handle 10, forming one piece with the latter. The return spring 9 is supported in the guide sleeve 30. When the actuator yoke 7 is pressed down, the sleeve 12 surrounding the return spring 9 is pushed into the guide sleeve 30. The guide attachment 28 additionally ensures smooth and non-jamming entry of the sleeve 12 in the interior of the handle 10 and the guide sleeve 30.

The sliding catch 17, which can be pushed into the recesses 16 in the sleeve 12 in order to lock the actuator yoke 7 in defined positions, is displaceably supported in a displacement guide arranged in the handle 10, said guide having the shape of a slot 33 in the illustrated embodiment. If desired, such a guide for the displacement of the sliding catch may have a different shape and form, e.g. the form of guide grooves or guide strips arranged in an opening surrounding the sliding catch 17 with a spacing from the latter. Such guides may be molded without major difficulties with the handle 10 in the manufacture of the latter, which, as a rule, is produced by pressing or injection molding.

Figure 3:
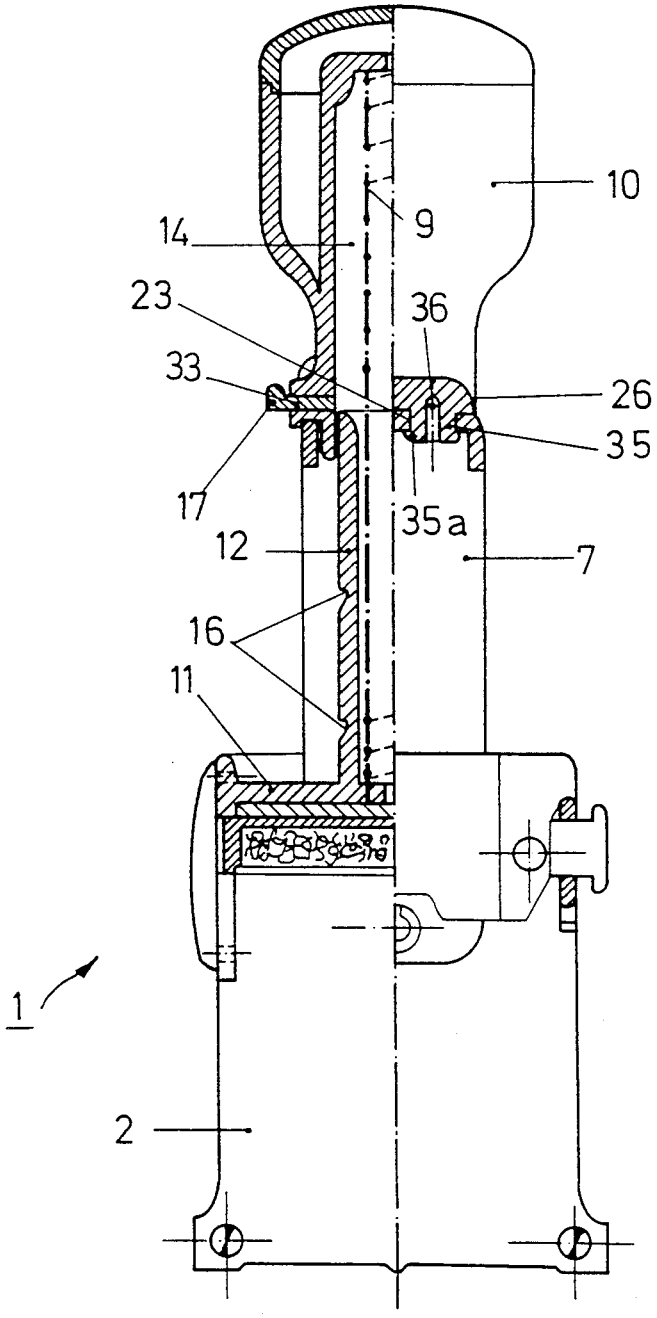
FIG. 3 shows a side view of another embodiment, partly in a sectional view similar to FIG. 2.
Figure 4:
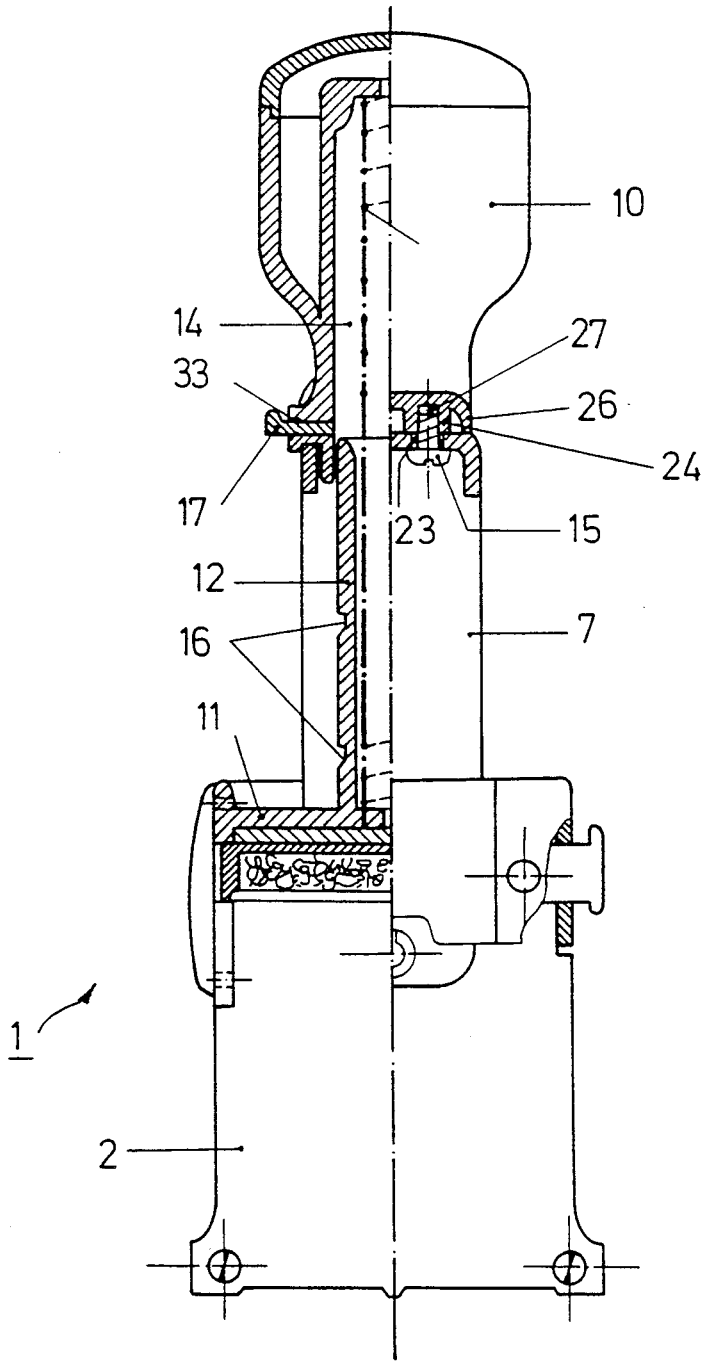
FIG. 4 shows yet another embodiment in the same view as FIG. 2.

In the embodiment according to FIG. 3, the pegs 35 are integrally molded with the actuator yoke 7 for fastening the handle 10, said pegs being locked in the recesses 23 of the actuator yoke 7 by plastic deformation. In the simplest case, such plastic deformation can be accomplished by pressing the projecting part 35*a* of the pegs 35 flat. Such flattening can be produced, for example with a heated tool, or with a tool vibrating at ultrasound frequency. By suitably selecting the material used for making the pegs 35 or the handle 10, it is possible under certain circumstances to simply press said part flat in the cold state. A more intimate fixing can be achieved by widening of the pegs 35. Such widening can be accomplished by axially inserting a mandrel in the pegs 35, so that a hollow space 36 is produced in said pegs 35, causing the circumference of the pegs to closely abut with a tight fit the edge of the openings 23. In the embodiment according to FIG. 4, the handle 10 is fixed on the actuator yoke 7 with a plurality of screws 15 extending through the holes 23. In this case, screws 15 are self-tapping screws turned into the handle 10, which is made of rigid plastic material. With this embodiment, it is advantageous to provide attachments 24 adjacent the edge 26 of the handle, i.e., in the locations where the screws 15 are to be turned into the handle. Guide bores 27 are formed in said attachments for receiving the screws 15.

If deemed desirable, the handle fixing means in the three illustrated embodiments can be combined by fitting some of the pegs with hook attachments and by deforming some of the pegs, or by first locking the pegs in place when they are inserted by letting hook attachments snap into the holes, and then intensifying the fixation by deforming the pegs.

I claim:

1. A self-inking tumble type hand stamp comprising (a) a stamp housing including (1) a crosspiece and (2) a sleeve having a circumference and projecting upwardly from the crosspiece, the sleeve circumference defining at least one recess, (b) an ink pad mounted in an upper portion of the stamp housing, (c) printing characters reversibly mounted in the stamp housing, the characters having an upwardly facing rest position adjacent the ink pad and a downwardly facing printing position, (d) a reversing mechanism for reversing the printing characters between the rest and printing positions, (e) a reciprocable metallic actuator yoke for operating the reversing mechanism to reverse the position of the printing characters, the actuator yoke being displaceably mounted on the upper portion of the stamp housing and having an upper and a lower position and reciprocable in a direction of the stamp axis between said upper and lower positions, (f) a hollow handle of rigid plastic material, the handle having a circumferential edge surrounding the stamp axis and having a side facing the actuator yoke and the actuator yoke defining a plurality of holes extending in the direction of the stamp axis and in alignment with the circumferential handle edge, (g) fastening elements passing through the holes and extending in the direction of the stamp axis for affixing the handle to the yoke, (h) a return spring surrounded by the upwardly projecting sleeve and having one end engaging the crosspiece and an opposite end extending into the hollow handle for support therein, the return spring biasing the actuator yoke into the upper position and the actuator yoke being reciprocable into the lower position against the spring bias, in which position the sleeve extends into the hollow handle, and (i) a sliding catch arranged to engage a respective recess in the sleeve for holding the actuator yoke in a defined position, the hollow handle further comprising a displacement guide in which the sliding catch is arranged.

2. The hand stamp of claim 1, wherein the fastening elements are self-tapping screws extending through the holes in the actuator yoke into the circumferential handle edge.

3. The hand stamp of claim 2, wherein the fastening elements are pegs integral with the circumferential edge of the hollow handle.

4. The hand stamp of claim 3, wherein the pegs have hook-shaped attachments arranged to snap into the holes.

5. The hand stamp of claim 4, wherein the pegs are plastically deformed for tight engagement in the holes.

6. The hand stamp of claim 5, further comprising a guide socket integral with the hollow handle and inwardly spaced from the circumferential edge, the guide socket surrounding the upwardly projecting sleeve and extending into the actuator yoke.

7. The hand stamp of claim 6, further comprising a guide sleeve integral with the hollow handle, the handle having an outwardly bulging outer wall and the guide sleeve being inwardly spaced from the outer handle wall and receiving the opposite return spring end, the guide sleeve including a guide socket surrounding the upwardly projecting sleeve and extending into the actuator yoke.

* * * * *